US005413370A

United States Patent [19]

Janisch et al.

[11] Patent Number: 5,413,370

[45] Date of Patent: May 9, 1995

[54] SKI BINDING

[75] Inventors: Andreas Janisch, Oeyenhausen; Helmut Wladar, Vienna; Hubert Wuerthner, Hainburg/Donau; Engelbert Spitaler, Wr. Neudorf, all of Austria

[73] Assignee: HTM Sport- und Freizeitgeraete Aktiengesellschaft, Schwechat, Austria

[21] Appl. No.: 78,302

[22] PCT Filed: Oct. 10, 1992

[86] PCT No.: PCT/EP92/02336

§ 371 Date: Jun. 17, 1993

§ 102(e) Date: Jun. 17, 1993

[87] PCT Pub. No.: WO93/07937

PCT Pub. Date: Apr. 29, 1993

[30] Foreign Application Priority Data

Oct. 18, 1991 [AT] Austria ..... 2085/91

[51] Int. Cl.[6] ..... A63C 9/08

[52] U.S. Cl. ..... 280/618; 280/633

[58] Field of Search ..... 280/611, 617, 618, 607, 280/633

[56] References Cited

U.S. PATENT DOCUMENTS 4,268,062 5/1981 Wittmann ..... 280/611

5,056,808 10/1991 Holzl et al. ..... 280/617

*Primary Examiner*—Richard M. Camby

*Attorney, Agent, or Firm*—Flynn, Thiel, Boutell & Tanis

[57] ABSTRACT

A ski binding including a front jaw, a heel holder and a connecting element consisting of two partial sections. The front jaw is slidingly movably supported in a ski-fixed guide rail and can be fixed in predetermined positions. The guide rail has a locking element with which the front partial section can be fixed. In order for the manufacturer to connect in this ski binding the guide rail for the front jaw and the front partial section to form one unit for easy transport, the front partial section of the connecting element has a cover with at least two locking members which engage corresponding recesses in the guide rail, the two locking members being reciprocally active against one another in vertical planes so as to prevent an inadvertent unlocking.

8 Claims, 3 Drawing Sheets

SKI BINDING

FIELD OF THE INVENTION

The invention relates to a ski binding having a front jaw and a heel holder connected together by a multiple part metal band.

BACKGROUND OF THE INVENTION

Such a ski binding is already known through products available on the market and is, for example, disclosed in the "ess news Catalog 1988" (published in connection with the ISPO '88 in Muenchen) and in the DE-OS 31 09 754 and in DE-GM 82 05 134. The connecting element is in this design divided into two partial sections for the purpose of adjusting the binding to various shoe sizes. One partial section of the connecting element had for this reason some type of serrated slats with which or from which two bolts of the other partial section, which bolts are flat on one side, could engage or disengage. To make this adjustment of the ski binding, the cover had to be removed and had to be put back in place after the adjustment had been completed. A screwdriver was needed for this in order to remove the cover and to disengage and engage the bolts.

The ski binding according to AT-PS 392 215, which has an undivided connecting element, has on the underside of the guide rail for the front jaw a square pin which is received in a square hole of the connecting element, which moreover has a row of holes having circular cross sections. This measure, however, does not create a permanent connection between the guide rail and the connecting element.

The brochure of the Tyrolia company 91/92 (No. 009072-12/90, distributed from Feb. 28 to Mar. 3, 1991 at the ISPO '91 in Muenchen) describes a ski binding in which the metal band is designed so that it is divided into two halves to make packaging easier. The end of one partial section carries two downwardly projecting bolts, each having a head, with which bolts are associated two keyhole-like recesses at the end of the other part. This design was, however, designated for use with a front jaw which was fixedly connectable on the ski. Furthermore, the rear partial section of the metal band carries the heel holder.

SUMMARY OF THE INVENTION

In general, the objects and purposes of the invention are met by a ski binding including a front jaw, a heel holder and a connecting element consisting of two partial sections. The front jaw is slidingly movably supported in a ski-fixed guide rail and can be fixed in predetermined positions. The guide rail has a locking element with which the front partial section of the connecting element can be fixed. In order for the manufacturer to connect in this ski binding the guide rail for the front jaw and the front partial section to form one unit for easy transport, the front partial section of the connecting element has a cover with at least two locking members which engage corresponding recesses in the guide rail, the two locking members being reciprocally active against one another in vertical planes so as to prevent an inadvertent unlocking after they have been connected together.

BRIEF DESCRIPTION OF THE DRAWINGS

The drawings show one exemplary embodiment of the invention.

DETAILED DESCRIPTION

Figure 1:
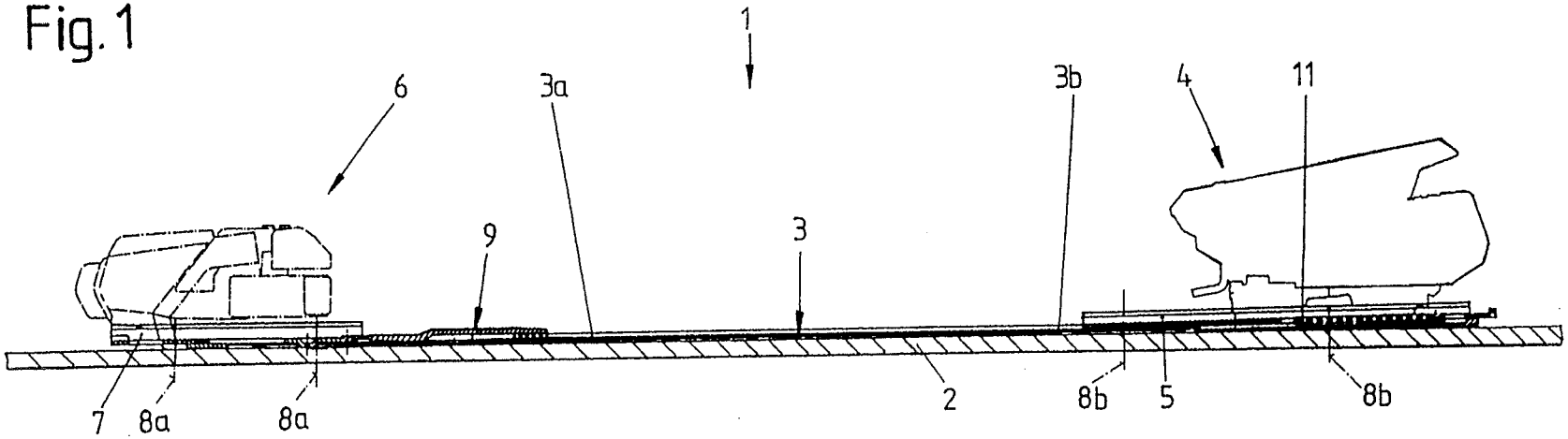
FIG. 1 is a vertical longitudinal center cross-sectional view of the ski binding in which the front jaw and the heel holder are only schematically shown.
Figure 2:
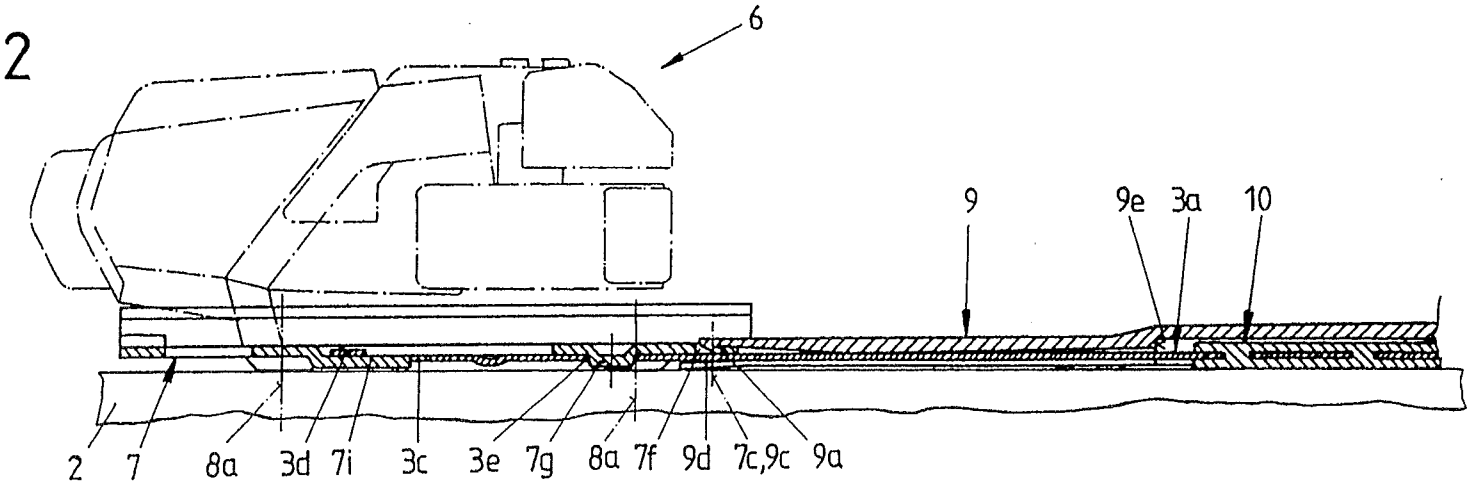
FIG. 2 shows a detail of the front partial section of the ski binding according to FIG. 1 in an enlarged scale.
Figure 3:
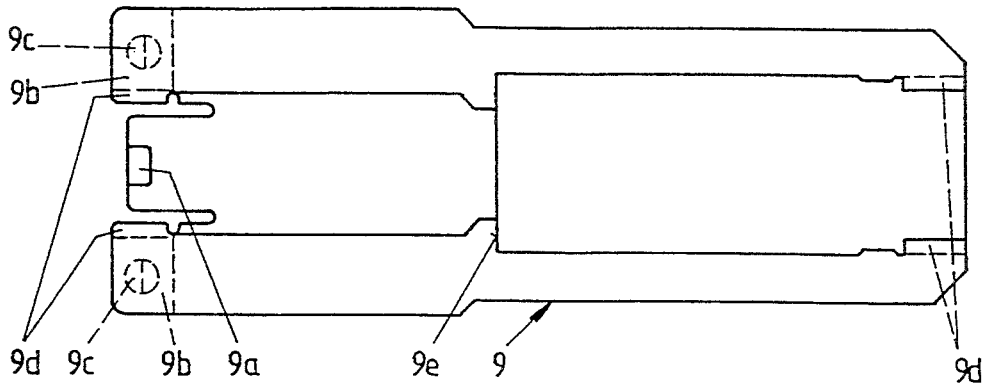
FIG. 3 is a top view of the front cover.
Figure 4:
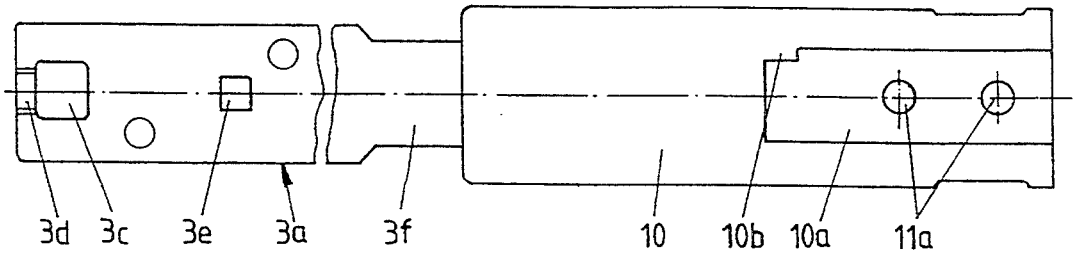
FIG. 4 is a top view of the front partial section of the connecting element.
Figure 5:
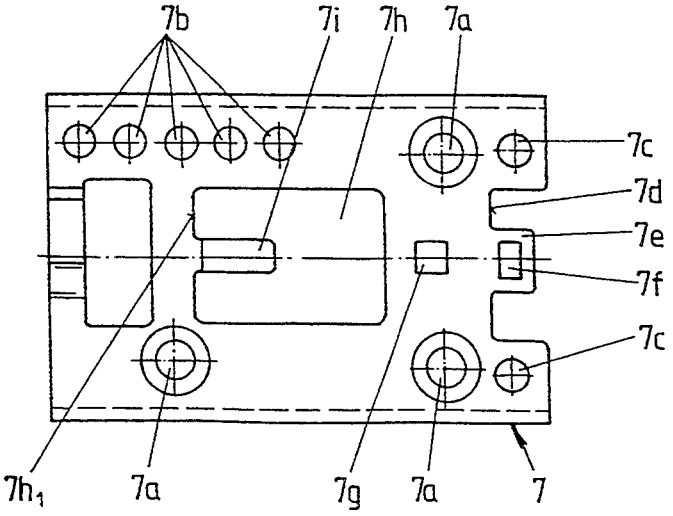
FIG. 5 is a top view of the guide rail.
Figure 6:
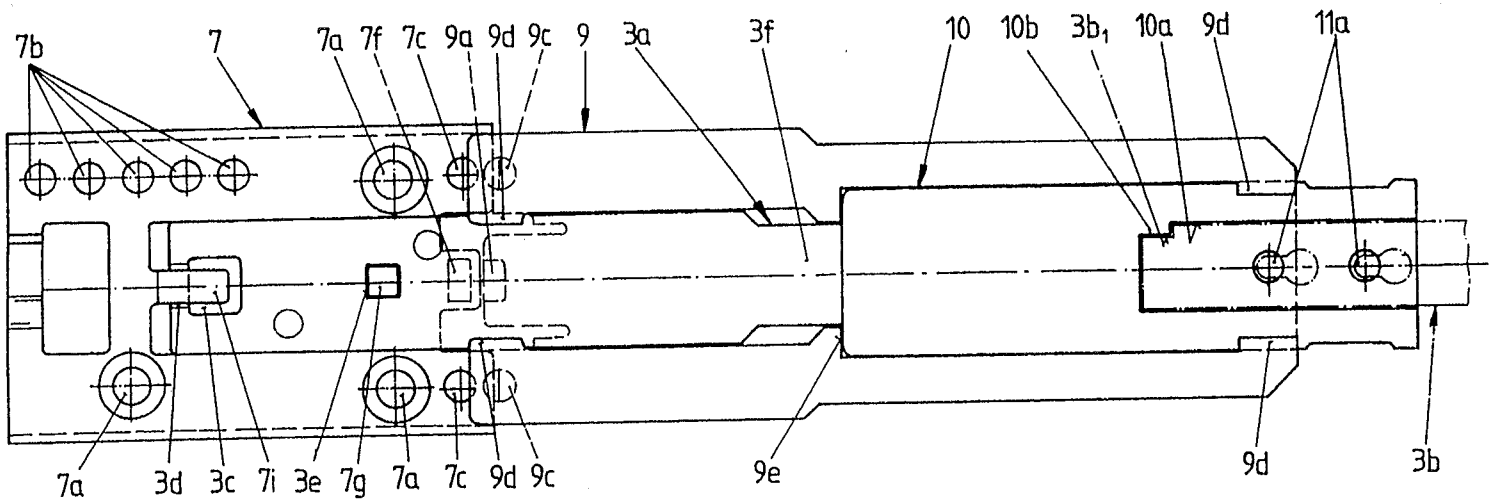
FIGS. 6 and 7 are top views of the guide rail, of the front partial section of the connecting element and of the cover, with the individual parts in FIG. 6 being assembled, however, not yet locked together, whereas the individual parts in FIG. 7 are already locked together and the connecting area of the rear partial section is also indicated.

A ski binding arranged on a ski 2 is identified in its entirety by the reference numeral 1 in the drawings. The ski binding 1 includes a connecting element 3 designed as a metal band, a heel holder 4 which is guided in a guide rail 5 fastened on the ski 2 by means of screws 8*b*, and a front jaw 6 which is supported adjustably and fixably in a further guide rail 7 and which is fastened on the ski 2 by screws 8*a*. The guide rail 5 of the heel holder 4 is connected to the metal band 3 with the heel holder 4 being lockable in different positions relative to the metal band 3. The metal band 3 consists of a front partial section 3*a* and a rear partial section 3*b*. A cover 9 manufactured of plastic is mounted on the front partial section 3*a*.

The guide rail 7 has three holes 7*a* to receive the fastening screws 8, and a row of holes 7*b* into one of which can be selectively received a cylindrical locking pin of the front jaw 6. Two holes 7*c* are recessed into the rear end of the guide rail 7, the purpose of which holes will be discussed in detail later on. A rearwardly open recess 7*d* is furthermore provided in the rear end of the guide rail 7. A projection 7*e* extends in the center of the recess 7*d*. A rectangular recess 7*f* lying approximately in the same transverse plane as the two holes 7*c* is provided in the projection 7*e*. A snap hook 9*a* arranged on the cover 9 extends from above into the recess 7*f*.

A square pin 7*g* is provided on the guide rail 7 approximately between the two oppositely lying holes 7*a*. A rectangular recess 7*h* is provided in the center of the guide rail 7, the front narrow side $7h_1$ of which recess 7*h* carries a downwardly bent and rearwardly directed hook 7*i*.

The front partial section 3*a* of the metal band 3 is associated with the guide rail 7. This partial section 3*a* has a rectangular recess 3*c* at its front end and has at its front end a transversely extending, upwardly bent web section 3*d* formed as by stamping. This web 3*d* rests in the mounted state of the ski binding 1 on the hook 7*i* of the guide rail 7. A square hole 3*e* is provided in the front partial section 3*a* spaced from the recess 3*c*, into which hole is received the square pin 7*g* of the guide rail 7 as soon as the guide rail 7 and the front partial section 3*a* of the metal band 3 are being assembled. The front partial section 3*a* is designed tapered at its rear end 3*f* and is provided with a sleeve 10.

Two horizontal attachments 9b exist on the front side of the cover 9 carrying upwardly extending locking pins 9c which, during the assembly of the guide rail 7 and the front partial section 3a, extend from below into the holes 7c of the guide rail 7. In order to facilitate the engagement, both the locking pin 9c and also the snap hook 9a are sloped at their front edges. The cover 9 carries one pair of opposing flaps 9d at its front and at its rear end, which flaps 9d guide the cover 9 onto the front partial section 3a or rather on its sleeve 10. The path of movement of the cover 9 onto the front partial section 3a is limited in one direction by the abutment of the front side of the sleeve 10 and of a section 9e of the cover 9 and in the other direction by the abutment of the shoulders of the tapered section 3f of the front partial section 3a on the shoulders of the section 9e. This path of movement is needed in order to permit the snap hook 9a to engage or disengage from the rectangular recess 7f in the guide rail 7 and the two locking pins 9c of the cover 9 to engage or disengage from the holes 7c of the guide rail 7.

In the rear end of the sleeve 10 is provided a flat recess 10a which is rectangular viewed from below, and which has a projection 10b at one front corner. With this projection 10b cooperates in the joined together state of the front and rear partial sections 3a and 3b a cutout $3b_1$ constructed at the front end area of said latter. This design prevents the rear partial section 3b of the metal band 3 from being inadvertently rotated at 180° about a longitudinal axis with respect to the front partial section 3a.

Figure 7:
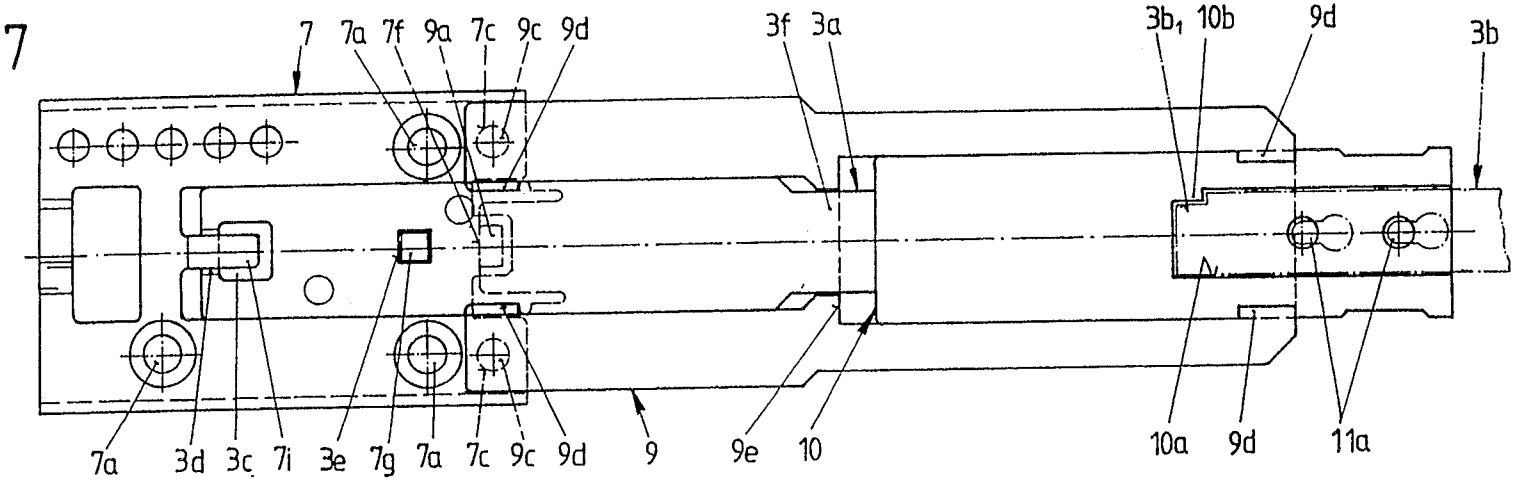

Two bolts 11 carrying the heads 11a are fastened in the metal band 3 in the area of the recess 10a of the sleeve 10. These bolts 11 extend into keyhole-like recesses in the rear partial section 3b in the connected state of the two partial sections 3a and 3b of the metal band 3. This position is indicated by dash-dotted lines in FIG. 7.

During the assembly of the guide rail 7 and the front partial section 3a of the metal band 3, the cover 9 is first placed onto the front partial section 3a, with the cover 9 being guided on this partial section 3a by the flaps 9d. The assembly consisting of the elements 3a and 9 is subsequently moved under the guide rail 7 until its square pin 7g extends into the square hole 3e of the front partial section and the bent web section 3d rests above the hook 7i.

In order to secure the elements 3a and 9 against separating, the cover 9 is moved slightly forwardly. The cover 9 is thereby locked relative to the guide rail 7 by the two locking pins 9c and the snap hook 9a. With this the assembly of the unit of elements 3a and 9 for transport and for installation has been completed. Should the ski binding 1, for whatever reasons, be removed from the ski and be disassembled, the guide rail 7 is first released from the ski 2 and the two partial sections 3a, 3b of the metal band 3 are separated from one another. The snap hook 9a is thereafter on the one hand removed from its recess 7f and on the other hand the two locking pins 9c are at the same time removed from their holes 7c by a spreading apart of these parts, the cover 9 is then pulled off in longitudinal direction from the guide rail 7.

The invention is not to be limited to the illustrated exemplary embodiment. Rather various modifications are possible without leaving the scope of the invention. It would for example be conceivable to arrange only two oppositely lying locking members on the cover, which members act against one another in vertical planes.

The embodiments of the invention in which an exclusive property or privilege is claimed are defined as follows:

1. A ski binding comprising a front jaw and a heel holder, a connecting element comprising a metal band consisting of two coupled partial sections, the connecting element extending in a longitudinal direction of the ski between the front jaw and the heel holder, the heel holder being arranged on a rearmost one of the two partial section of the metal band, adjustment means for facilitating a selective longitudinal positioning of the heel holder relative to the rearmost one of the two partial sections, the adjustment means including a ski-fixed guide rail, the front jaw being slidably supported for movement in a further ski-fixed guide rail and being selectively releasably fixable in predetermined positions to the further ski-fixed guide rail, and a locking means for lockingly connecting the further ski-fixed guide rail to the front partial section of the metal band, the improvement wherein the front partial section of the metal band includes a securement means for securing the front partial section to the further ski-fixed guide rail and against a relative movement with respect thereto along a longitudinal axis thereof, the further ski-fixed guide rail having at least two locking recesses therein, the securement means including a cover having at least two locking members which are received in the locking recesses, the two locking members being reciprocally operative against one another in vertical planes so as to prevent an inadvertent unlocking.

2. The ski binding according to claim 1, wherein the securement means for securing the front partial section to the further ski-fixed guide rail includes an attachment provided on the further ski-fixed guide rail and, in the front partial section of the metal band, one single attachment receiving recess is provided corresponding in cross section to a cross section of the attachment, and wherein an area of the further ski-fixed guide rail includes a hook which overlaps the front partial section, a coined segment being provided in the area of the hook on the front partial section, the coined segment positively engaging the hook.

3. The ski binding according to claim 2, wherein the attachment is a square pin and the attachment receiving recess is a square hole.

4. The ski binding according to claim 1, wherein three locking members, namely, one downwardly extending snap hook and two upwardly projecting locking pins, are provided on the cover, wherein the snap hook, is oriented adjacent a center section of the cover and is operatively received in a snap hook receiving recess in the guide rail, and wherein the two locking pins are arranged on two horizontal attachments provided adjacent a pair of lateral edges of the cover, the further ski-fixed guide rail having two holes therein that conform to the locking pins which are received in the holes.

5. The ski binding according to claim 4, wherein a front side of each of the two locking pins and of the snap hook are sloped, the slopes being directed upwardly on the snap hook from front to rear and downwardly on the two locking pins also from front to rear.

6. The ski binding according to claim 1, wherein the cover has at both of its front and its rear ends a pair of opposing flaps for guiding the cover on at least one of the front partial section and a sleeve provided on the front partial section.

7. The ski binding according to claim 1, wherein the front partial section of the connecting element has a sleeve, wherein a path of movement of the cover on the front partial section is limited in one direction by an abutment of the front side of the sleeve on a section of the cover and in the other direction by an abutment of a shoulder on a tapered section with an opposite facing side of the shoulder of the section.

8. The ski binding according to claim 7, wherein the sleeve has in the area of a rear end thereof a rectangular recess, in a front corner of which is provided a projection which conforms to a corresponding cutout in the front end area of the rear partial section of the metal band.

* * * * *

UNITED STATES PATENT AND TRADEMARK OFFICE

CERTIFICATE OF CORRECTION

PATENT NO. : 5,413,370
DATED : May 9, 1995
INVENTOR(S) : Andreas Janisch et al

It is certified that error appears in the above-indentified patent and that said Letters Patent is hereby corrected as shown below:

Column 4, line 51, after "hook" delete --, --.

Signed and Sealed this

Twenty-sixth Day of September, 1995

*Attest:*

Bruce Lehman

BRUCE LEHMAN

*Attesting Officer*

*Commissioner of Patents and Trademarks*